US007922188B2

(12) United States Patent
Kogler et al.

(10) Patent No.: US 7,922,188 B2
(45) Date of Patent: Apr. 12, 2011

(54) ARRANGEMENT CONSISTING OF A SKI BINDING AND A SKI BOOT

(75) Inventors: Hannes Kogler, Vöcklabruck (AT); Manfred Grünbart, Mettmach (AT); Alois Pieber, Hohenzell (AT)

(73) Assignee: Fischer Sports GmbH, Ried im Innkreis (AT)

( * ) Notice: Subject to any disclaimer, the term of this patent is extended or adjusted under 35 U.S.C. 154(b) by 99 days.

(21) Appl. No.: 11/997,226

(22) PCT Filed: May 31, 2006

(86) PCT No.: PCT/AT2006/000227

§ 371 (c)(1),
(2), (4) Date: Jan. 29, 2008

(87) PCT Pub. No.: WO2007/012091

PCT Pub. Date: Feb. 1, 2007

(65) Prior Publication Data

US 2008/0272577 A1 Nov. 6, 2008

Related U.S. Application Data

(63) Continuation of application No. PCT/AT2006/000227, filed on May 31, 2006.

(30) Foreign Application Priority Data

Jul. 29, 2005 (AT) ..... 1283/2005

(51) Int. Cl.
*A63C 9/20* (2006.01)

(52) U.S. Cl. ..... 280/615

(58) Field of Classification Search ..... 280/613, 280/614, 615, 625, 631, 632, 635
See application file for complete search history.

(56) References Cited

U.S. PATENT DOCUMENTS

| | | | | |
|---|---|---|---|---|
| 4,659,103 | A * | 4/1987 | Tessaro | 280/615 |
| 4,907,817 | A * | 3/1990 | Schwarz | 280/615 |
| 4,917,400 | A * | 4/1990 | Salomon et al. | 280/615 |
| 4,959,913 | A * | 10/1990 | Provence et al. | 36/117.2 |
| 5,108,125 | A * | 4/1992 | Callegari | 280/615 |
| 5,190,310 | A | 3/1993 | Hauglin et al. | |
| 6,209,903 | B1 * | 4/2001 | Girard | 280/615 |

(Continued)

FOREIGN PATENT DOCUMENTS

| | | | |
|---|---|---|---|
| DE | 4241145 | A1 * | 6/1994 |
| EP | 0424479 | A1 | 5/1991 |
| FR | 2741543 | A1 | 5/1997 |

(Continued)

*Primary Examiner* — J. Allen Shriver, II
*Assistant Examiner* — John D. Walters
(74) *Attorney, Agent, or Firm* — Laurence A. Greenberg; Werner H. Stemer; Ralph E. Locher

(57) ABSTRACT

A configuration contains a ski binding and a ski boot, whereby a sole of the boot is connected to the ski binding by a maintaining element and performs a rolling off movement when the heel is lifted. The maintaining element contains at least three fixed points, whereby at least one fixed point acts as a rotational point in the region of the ski when the ski boot is lifted, at least one second point is connected to the sole of the boot in the ball region, and at least one third point is provided in the region of the tip of the sole in order to couple the ski binding to the ski boot.

13 Claims, 9 Drawing Sheets

U.S. PATENT DOCUMENTS

| | | | | |
|---|---|---|---|---|
| 6,374,517 | B2 * | 4/2002 | Girard et al. | 36/117.3 |
| 6,402,184 | B1 * | 6/2002 | Hauglin | 280/615 |
| 6,986,526 | B2 * | 1/2006 | Haughlin | 280/613 |
| 2003/0168830 | A1 | 9/2003 | Haughlin | |

FOREIGN PATENT DOCUMENTS

| | | |
|---|---|---|
| WO | 8403225 A1 | 8/1984 |
| WO | 9011806 A1 | 10/1990 |
| WO | 0193963 A1 | 12/2001 |

* cited by examiner

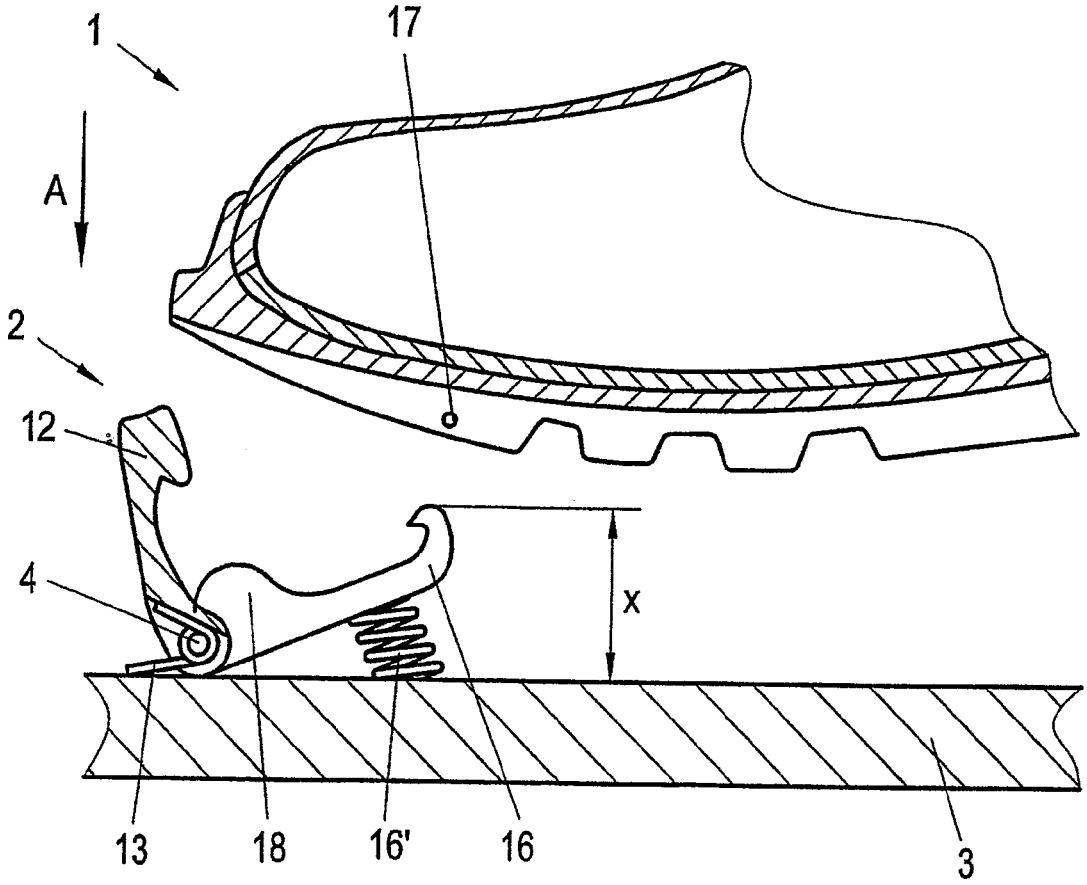
FIG. 4.1

FIG. 6
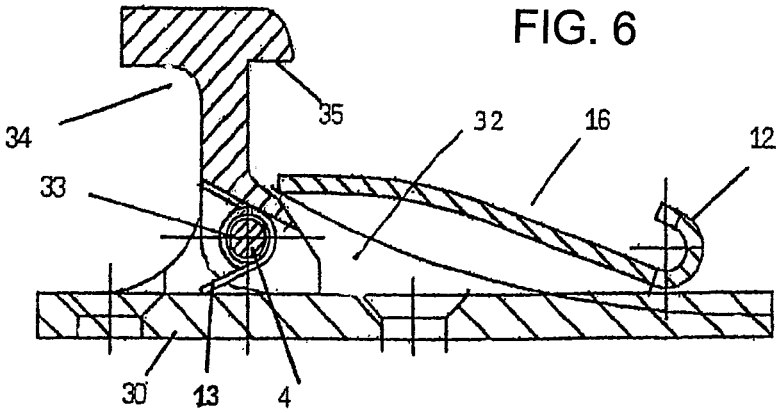
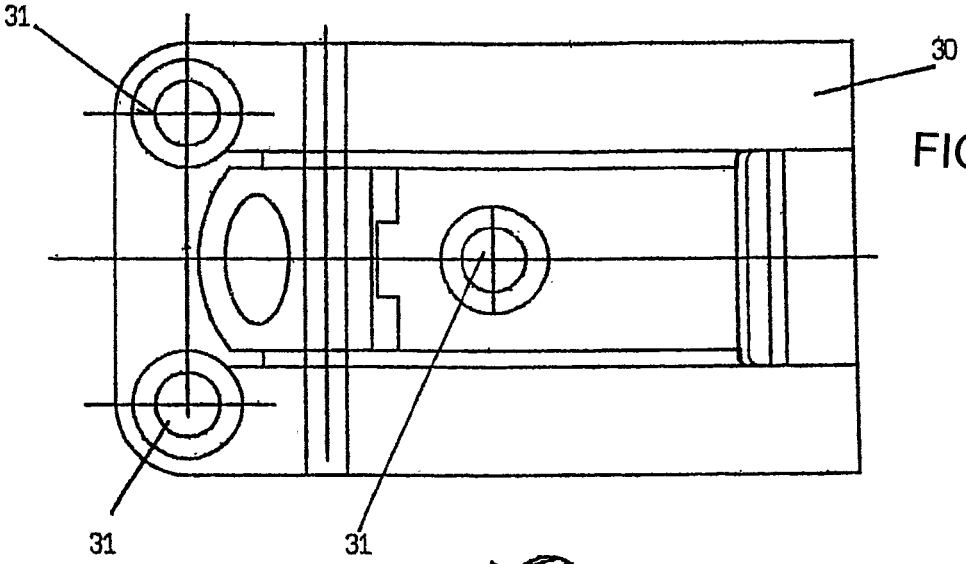
FIG. 7
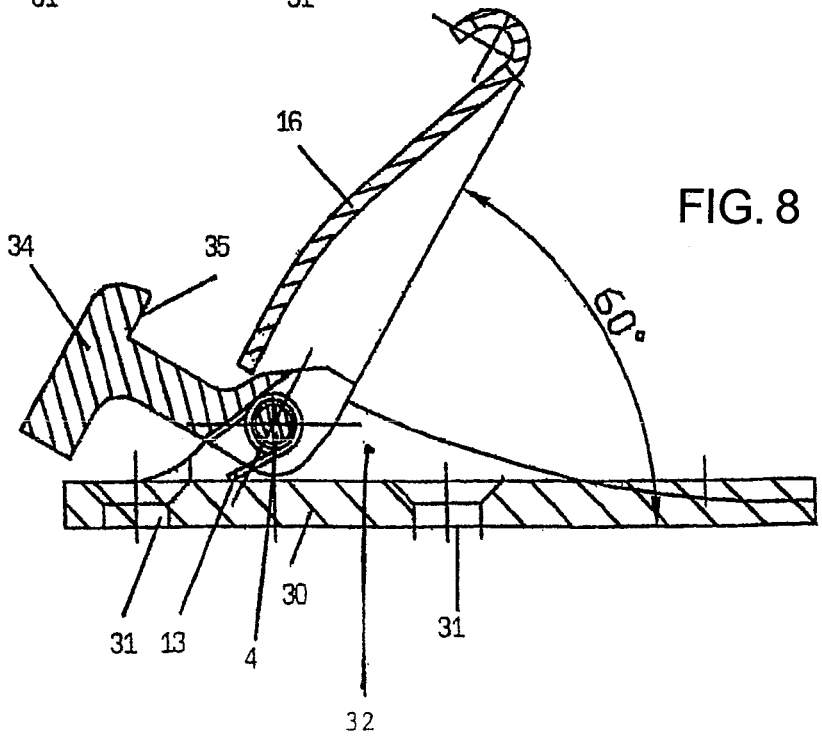
FIG. 8

ARRANGEMENT CONSISTING OF A SKI BINDING AND A SKI BOOT

BACKGROUND OF THE INVENTION

Field of the Invention

The invention relates to an arrangement according to the classifying clause of claim 1.

Cross-country ski bindings with rigid axes that are mounted to the boot and primarily fastened in the toe region while being pivotable about an axis located transverse to the ski by an articulated connection attached to the ski are known in various configurations. Such a configuration enables the front end of the ski boot to be secured to the ski during cross-country skiing or downhill skiing in the Telemark style, while the rear end of the ski boot can be freely lifted. A binding of this type is, for instance, known from EP 0 424 479. With that binding, a substantially flat boot sole is used. This is necessary in order to enable the pivotal point to be positioned near the sole contact zone.

It is generally known that flat boot soles are unsuitable for normal walking from an ergonomic point of view, since they prevent the natural rolling movement.

Another characteristic feature of such boot/binding systems also resides in that the boot sole, in the tip region, has a corner-shaped configuration which serves to receive the rigid axis of rotation anchored in the boot sole. During normal walking, that configuration is additionally inconvenient, since the rolling movement is effected about an unnatural tilting edge.

Configurations as are, for instance, known from PCT/EP84/00047 enable natural rolling movements during walking, yet the connection to the ski by means of a flexible, leaf-shaped connection is no longer state of the art, since the lateral and torsional stabilities required for cross-country skiing are no longer ensured.

An arrangement of the initially mentioned kind has become known from WO 01/93963.

That arrangement enables a rolling movement of the foot on the ski during skiing and also an anatomically correct rolling of the foot during normal walking. The drawback of that embodiment resides in the elaborate production of the system, involving high costs. In addition, the freedom of movement (lifting of the heel) in the proposed solution is limited by a damper element positioned below the tip of the boot. U.S. Pat. No. 6,209,903 B1 describes a fastening system to connect a boot with a ski and ensure a limited angle of aperture. The objective of the document is, thus, totally different from that of the present invention. Another characteristic feature of that document is that the rear engagement element has to be flexibly or at least elastically mounted, which results in an additional instability and increases production costs.

From FR 2 741 543, a connection has become known, which meets the demands placed on a boot sole that is correctly designed from an anatomical point of view. However, it involves the disadvantage of the connection being provided in the region of the metatarsophalangeal joint with a damper element provided below the toe region, which would likewise restrict the necessary heel lift. In addition, a cross-country skier will feel insecure at a rearward weight transfer, since the boot is not fixed below the tip of the toe.

BRIEF SUMMARY OF THE INVENTION

It is the object of the present invention to provide a favorable, yet stable connection to the cross-country ski in a boot sole configuration that is correct from an anatomical point of view, while avoiding the drawbacks of known constructions.

This object is achieved by the measure according to the characterizing clause of claim 1. This is the simplest way to renounce complex and cost-intensive kinematics. It is based on a simple rotation about a fixed axis in the region of the tip of the boot, as it will be found as a standard in all current cross-country ski bindings.

Further advantages of the invention result from the measures according to claims 2 to 10.

The subject matter of the invention is also a cross-country ski boot for the binding according to the invention, which meets the orthopedic demands.

An exemplary embodiment of the arrangement according to the invention is illustrated in the attached drawings.

Therein, in a simplified illustration:

BRIEF DESCRIPTION OF THE SEVERAL VIEWS OF THE DRAWING

FIGS. 6 to 8 depict further variants of the tip-side binding unit in an axial longitudinal section in the closed position, viewed from below, and in an axial longitudinal section in the opened position;

DESCRIPTION OF THE INVENTION

Figure 1:
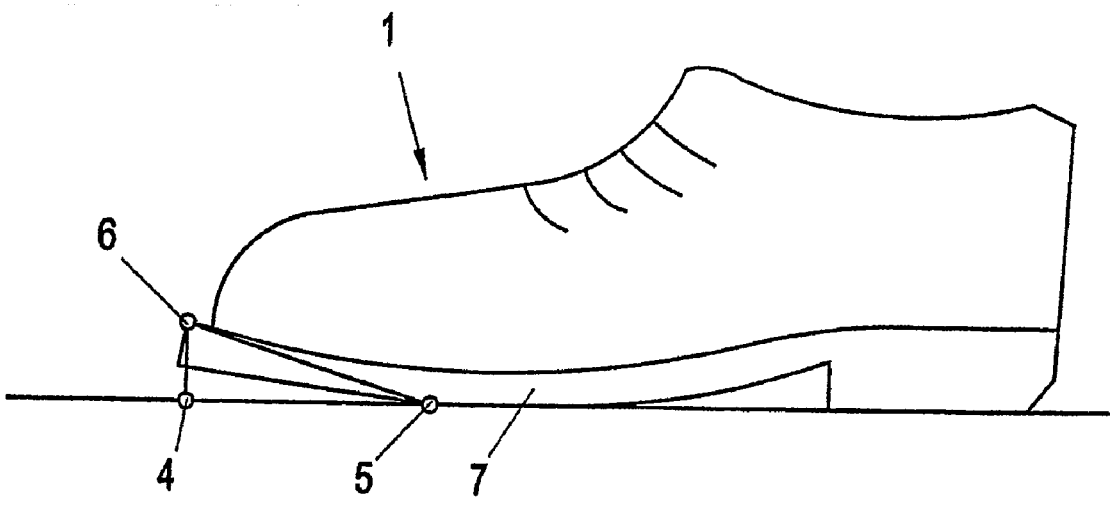
FIG. 1 is a side view of a cross-country ski boot in which the principle of the connection between boot and binding is indicated.
Figure 2:
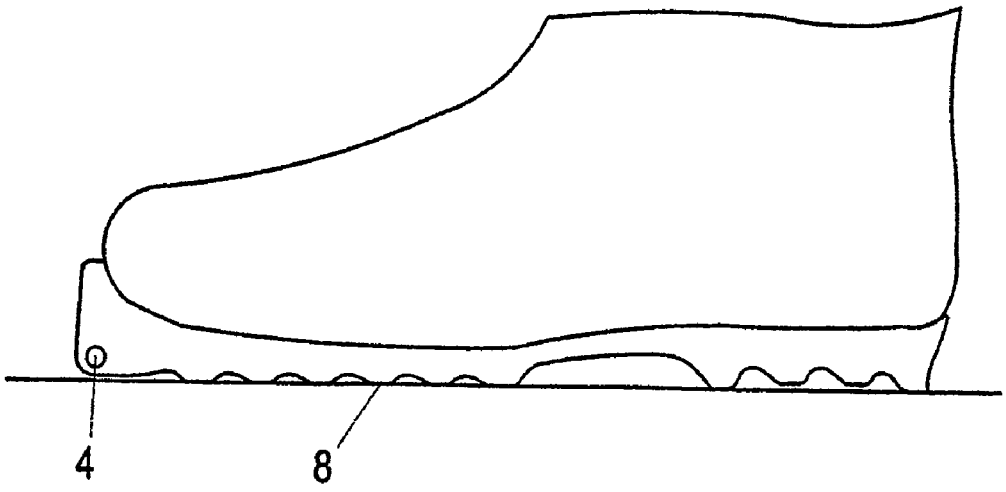
FIG. 2 depicts a known embodiment of a cross-country ski boot having a boot sole part projecting in a corner-like manner.

In the Figures, a cross-country ski boot is denoted by 1, which is connectable with the ski on the side of the tip by a binding unit 2 (FIGS. 3 and 4) which comprises at least three, in the present case three, fixed points 4, 5 and 6 forming a rectangular triangle having the fixed points 4, 5 and 6 in FIG. 1, yet this is not necessarily required. The proposed system is pivotable about the fixed point 4 serving as a pivot point, which, as in the present case, is preferably located in the corner of the imaginary triangle having the largest interior angle, i.e. 90° in the illustrated embodiment with a rectangular triangle. As shown in FIG. 1, the two legs are oriented from the pivot point in the direction towards the sole connection points. The hypotenuse is defined by the imaginary distance between the two sole connection points. The binding element, thus, virtually becomes a part of the boot sole during cross-country skiing. This part to be used for cross-country skiing, or the respective region of the sole including the pivot point near the sole/ski contact zone, offers the advantage over the cross-country ski boot sole including an embedded axis of rotation, as is presently common and illustrated in FIG. 2, that the sole portion used for cross-country skiing can be uncoupled for free walking and, hence will not impede the natural rolling movement.

An essential advantage of the proposed solution, however, resides in that the pivot point of the system can be provided below the sole/ski contact zone even without raising the standing position. This is of advantage because the rolling movement is the more easily feasible the deeper the pivot point, based on the sole/ski contact zone.

Another advantage of the proposed solution resides in that the pivot point, as a function of the construction, can be arranged both below the tip of the boot and some millimeters behind the same, in order to thus be able to exert further positive effects on the rolling movement during cross-country skiing.

The invention follows the basic idea that the function of normal walking without skis and the function of cross-country skiing with skis are separated from each other. The movement of the sole during walking without skis corresponds to a kinematics that combines rotation and translation movements, whereas the movement of the sole during cross-country skiing is realized by a simple rotation.

The connection point 5 in the ball region of the ski boot sole 7, which will be described in more detail below, as well as the anchorage point 6 in the region of the ski boot tip for the connection of the cross-country ski boot 1 to the binding unit 2 are, at the same time, not rotation points, but merely serve to rigidly and hence stably connect the rotationally mounted binding unit with the boot sole 7.

The binding element 2 is substantially comprised of three parts, namely the axis of rotation 4' acting as a hinge, a front retaining element 9 as well as a retaining element not illustrated. The axis of rotation 4' or hinge joint, respectively, which coincides with the pivot point 4, can be firmly or detachably connected with the ski 3.

The front retaining element 9, by the aid of a commercially available tenter hook 10, is latchable into a tip-side sole extension 11 devised as a step projecting from the tip side.

Figure 4:
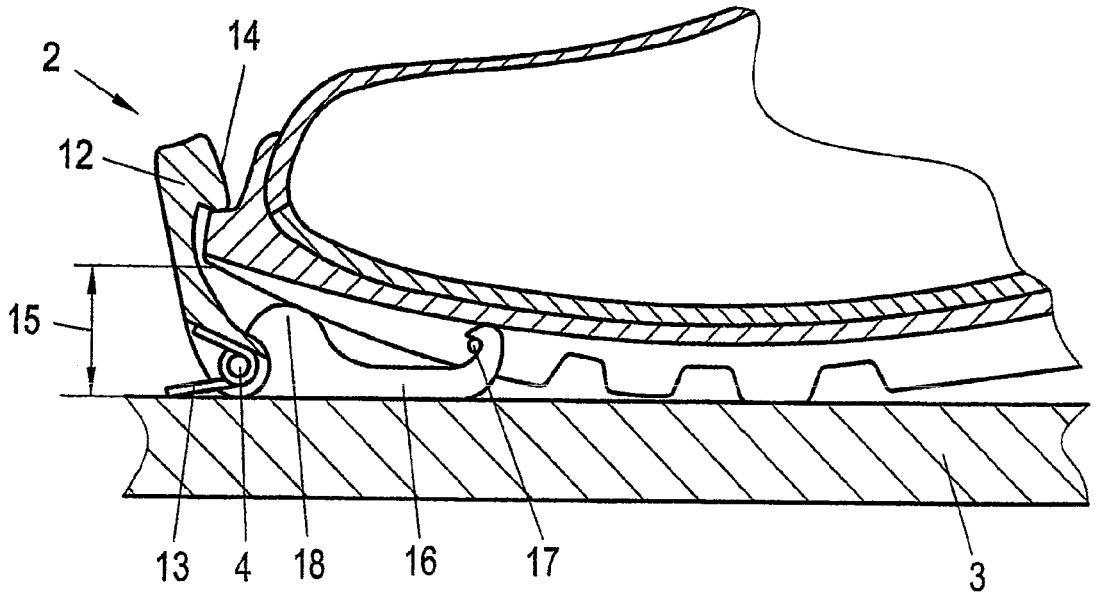
FIGS. 4 and 4.1 are similar longitudinal sections in different positions of the cross-country ski boot, including a rotating hook as the tensioning device.

In a modified embodiment of the retaining element 5, a hook 12 rotating about the axis of rotation 4 is provided as shown in FIG. 4, which hook is pressed against the sole extension 11, preferably by a torsion spring 13. The hook surface 14 is designed such that the binding can also be devised as a step-in binding. In order to facilitate this step-in function, it will be particularly advantageous, if the hook element 16 in the open state is kept at a distance from the upper surface of the ski by a defined measure x.

As illustrated in FIG. 4.1, this characteristic feature of the invention is achieved in that the hook element 16 is pressed away from the upper surface of the ski by a measure x, and held in that position, by a spring element 16' which may be of any design, e.g. a torsion spring, a swivel spring or even a rubber-elastic component, for instance.

This will considerably facilitate the stepping into the binding by the boot 1 with its axis 17, which moves into the sense of arrow A when stepping into the binding.

The length of the front retaining element 9 depends on the height of the outer toe spring 15. The higher the outer toe spring 15, the longer the front retaining element 9 must be designed.

Figure 3:
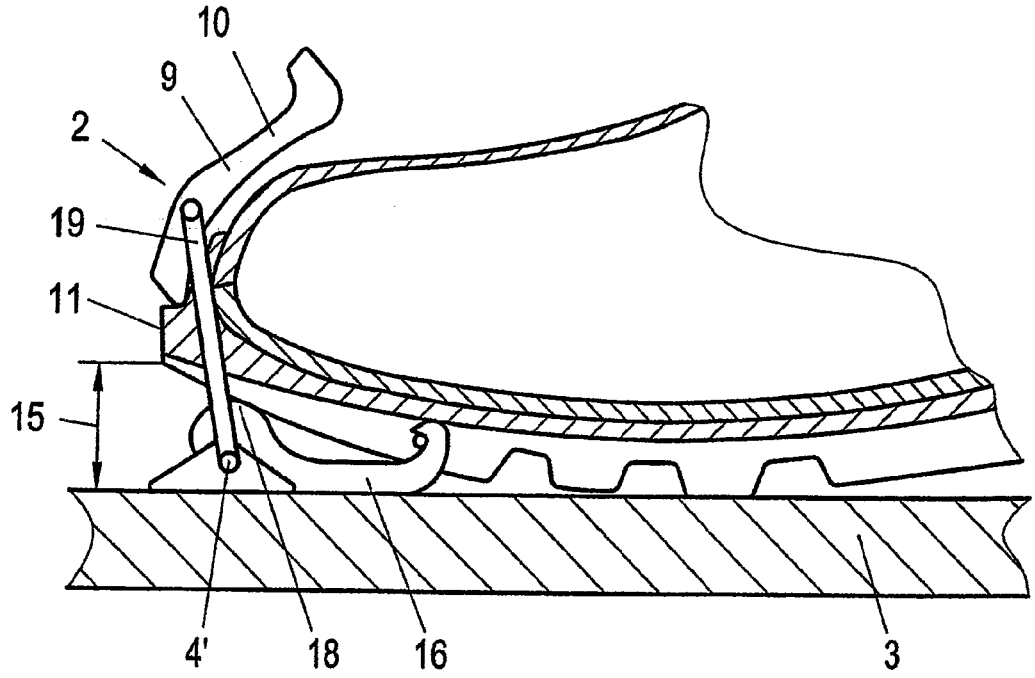
FIG. 3 is a longitudinal section through the tip portion of the cross-country ski boot according to the invention, including a tenter hook.

As illustrated in FIGS. 3 and 4, the rear retaining element 16, or rear connection, is realized by a hook element 16 which engages an axis 17 rigidly anchored in the sole side, preferably by an injection-molding technique, and corresponding with the initially mentioned connection point 5. The hook element 16 is designed to be stiff or rigid, i.e. not flexible, and pivotable about the axis 4'. It comprises a bead 18 near the axis of rotation or hinge 4', which serves to support the front sole surface located near the tip of the boot. This bead 18, at the same time, provides a material compensation between the sole rounded by the outer toe spring 15, and the rather plane upper surface 3 of the ski. Alternatively, the rear hook element 16 may also holohedrally contact the sole surface (without any specific bead formation).

While the hook 12, in the embodiment according to FIG. 4, is pivotable about the hinge 4, the tenter hook 10, in the embodiment according to FIG. 3, is designed as a double-armed pivot lever which is connected with a lever 19 articulately connected to both ends between its longer arm, which is configured as an actuation lever, and its shorter arm, which is configured as a latch. Finally, the binding element 2 may, for instance, be equipped with a leg spring 20, which dampens and/or delimits the pivotal movement of the boot sole. In accordance with the invention, said leg spring 20 may, at the same time, function as a torsion spring 13. In that case, the function of pressing the rotating hook 12 and damping/delimiting the pivotal movement of the boot sole is taken over by a single engineering component.

The toe spring 15 is responsible for the boot sole to meet the orthopedic requirements, which means that the sole will still have a rounded shape starting from the ball contact point forwardly in the direction to the tip of the boot.

The longitudinal axis 17 is preferably located about 4 cm behind the tip of the boot and, as already mentioned, may be embedded in a groove extending transversely to the running direction by injection molding. The rear hook element 16 substantially extends from the pivot point or hinge 4' in a longitudinally extending central groove as far as to the axis 17, thus offering the advantage of the rear hook element being able to take up transverse forces via the abutting, lateral inner walls of the longitudinally extending central groove, which promotes a substantial stabilization of the overall system.

Figure 5:
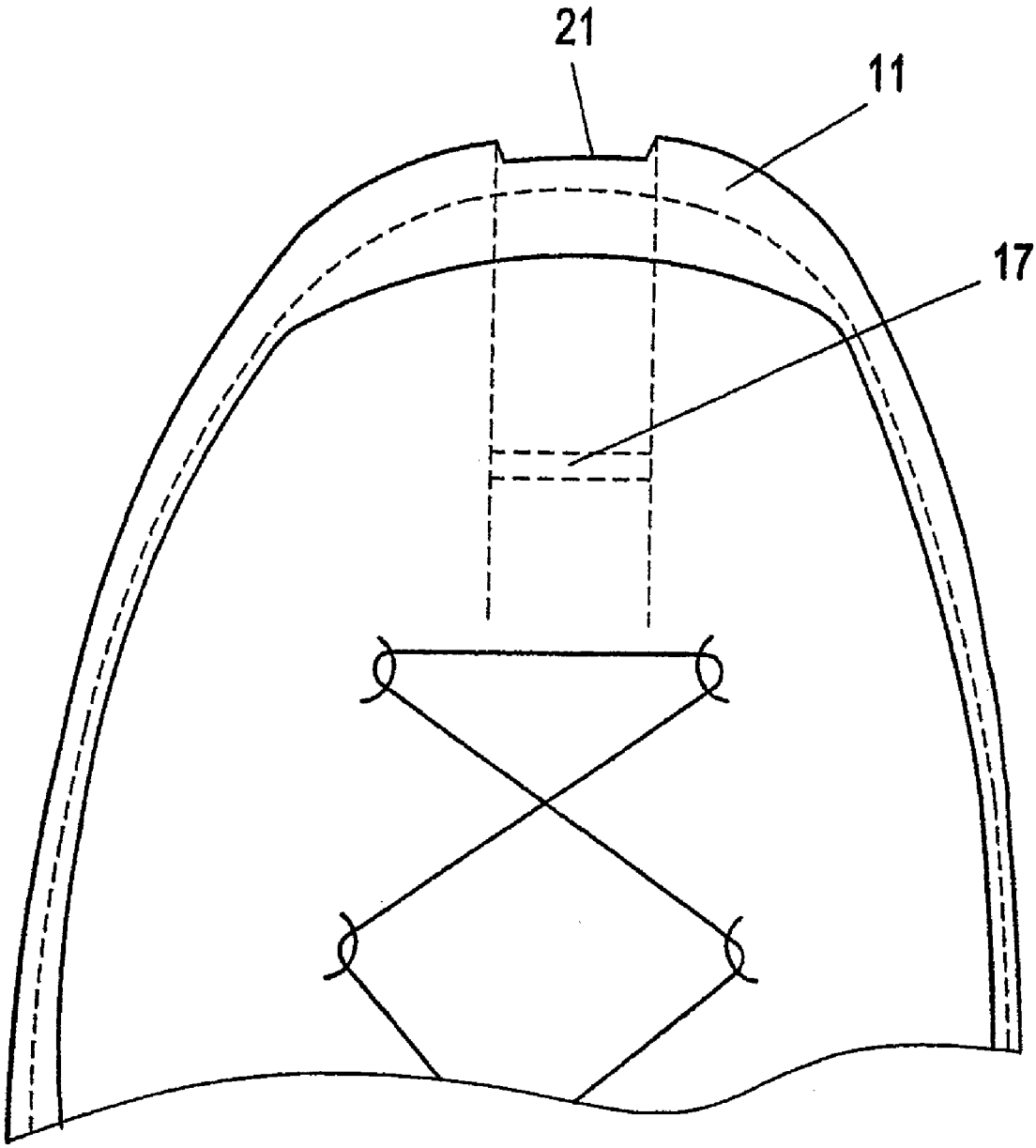
FIG. 5 illustrates the tip region of an embodiment of the boot sole.

As illustrated in FIG. 5, the sole extension 11 may be equipped with a groove 21, which, when hooked with the front retaining element 9, is able to take transverse forces, thus serving to laterally stabilize the system.

The configuration according to the invention of the binding unit 2 does not require a raised standing position as opposed to presently used systems.

In the other illustrations of different embodiments of the tip-side binding unit according to FIGS. 6 to 18, 30 serves to denote a base plate to be fastened to a ski, e.g. by screws, to which end the former comprises at least two, preferably three or four, holes 31, which may be provided in any distributed manner. The base plate 30, in its longitudinal center, comprises an upwardly extending projection 32 including a hole 33 extending transversely to the ski axis for receiving the axis 4 surrounding the spring 13 at least over a portion of its periphery.

In the embodiment according to FIGS. 6 to 8, a lever 34 is rotationally mounted on the axis 4 to carry the hook element 16, which forms an angular pivot lever with a lever 34. The hook element 16, which serves to receive the boot axis, is made of edged spring steel sheet. The hook element 16 incorporates the spring 13 which encloses the axis 4, preferably by 5¼ windings, and, in the resting state, presses the hook element 16 against the ski while biasing the same such that, at the step-in of the boot, a force will be exerted on the boot by the tip of the boot behind the undercut 35 of the lever 34, thus holding the boot in the binding. Moreover, the spring 13 provides a resistance against the forward tilting of the skier during cross-country skiing when lifting the foot. The tilting angle in the present case is preferably 60°.

Figure 9:
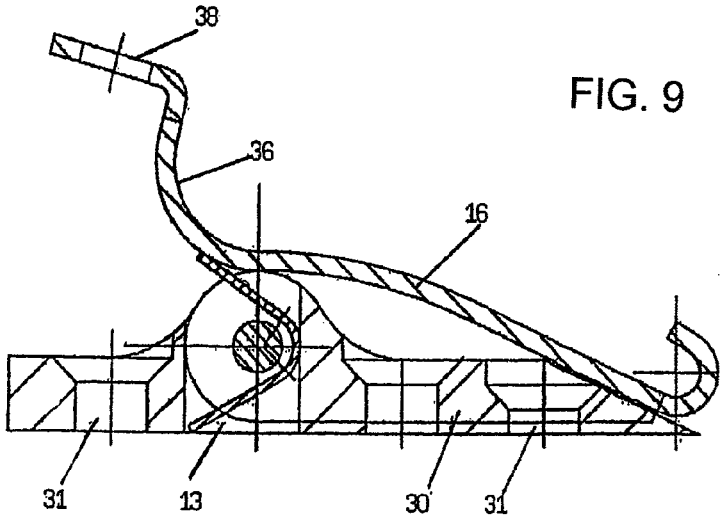
FIGS. 9 to 11, 12 to 14 and 15 to 17 each in illustrations similar to those of FIGS. 6 to 8 depict further variants of the tip-side binding unit.
Figure 10:
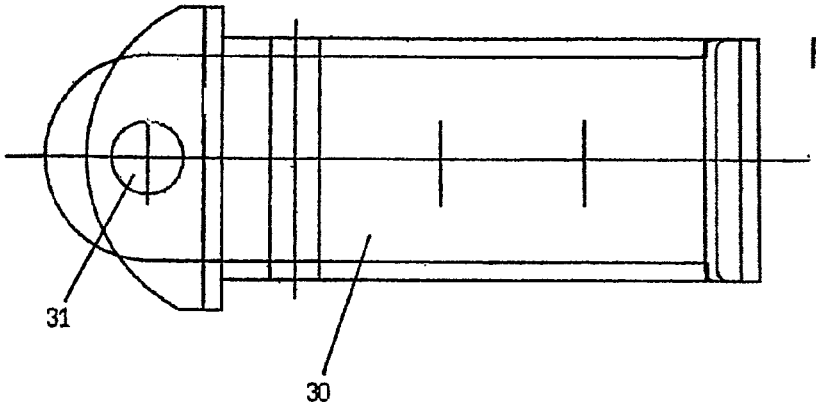
Figure 11:
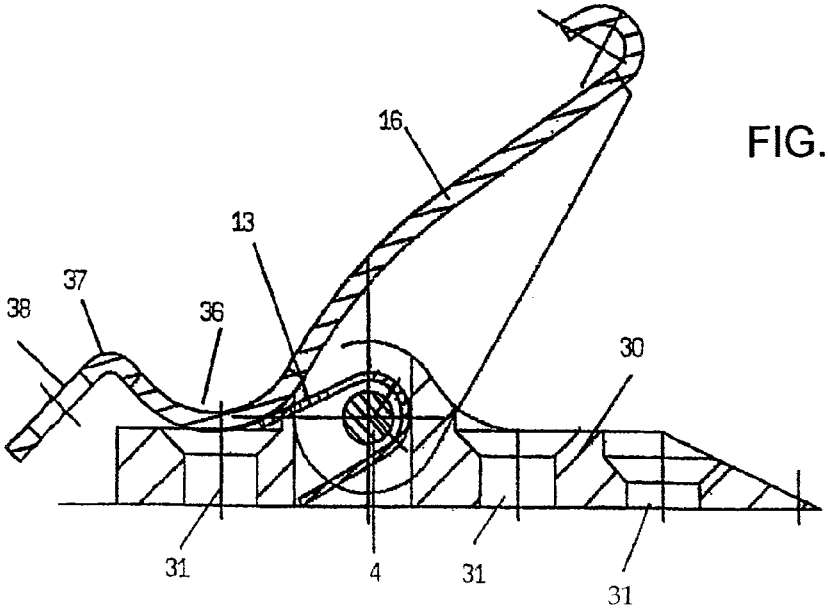

In the embodiment according to FIGS. 9 to 11, the hook element 16, as opposed to the preceding embodiment, on its end facing away from the hook 12, is provided with an arc 36 corresponding with the sole contour and chamfered on the end so as to form an angle 37 oriented towards the ski and including a hole 38 for inserting the ski pole to open the binding. The chamfer forming the angle 37 ensures lateral stability. This embodiment enables a narrow construction and offers the advantage of the retention force merely occurring from the material deformation of the spring steel sheet of the hook element 16. This construction, moreover, ensures that the whole retaining and guiding mechanism can be received in the groove of the boot sole so as to be invisible.

Figure 12:
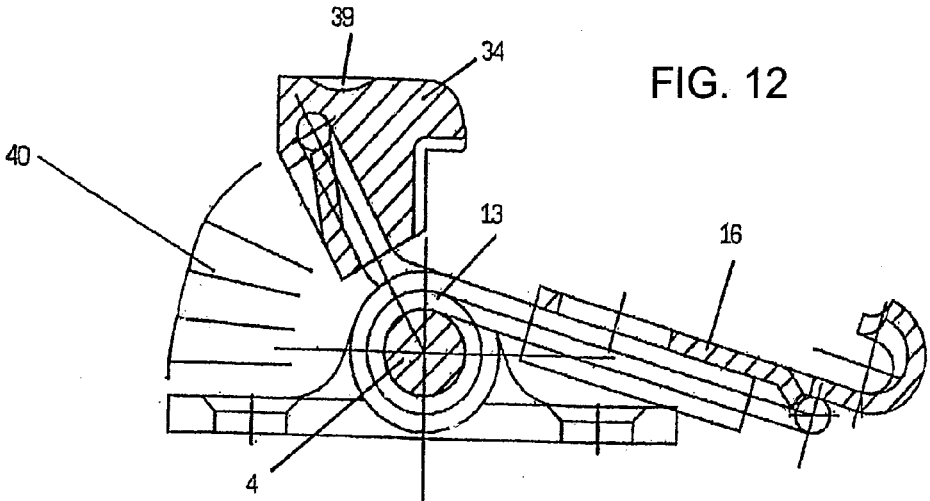
Figure 13:
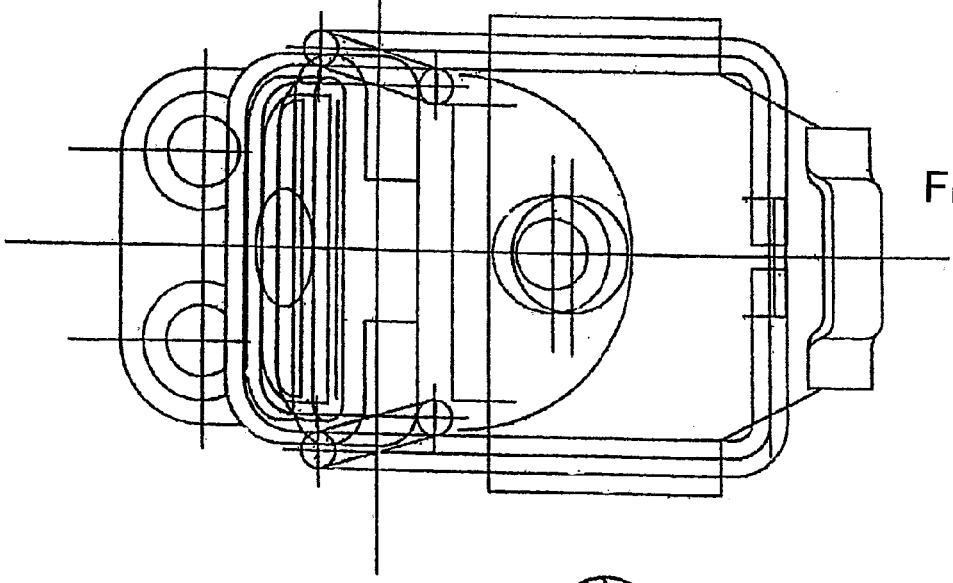
Figure 14:
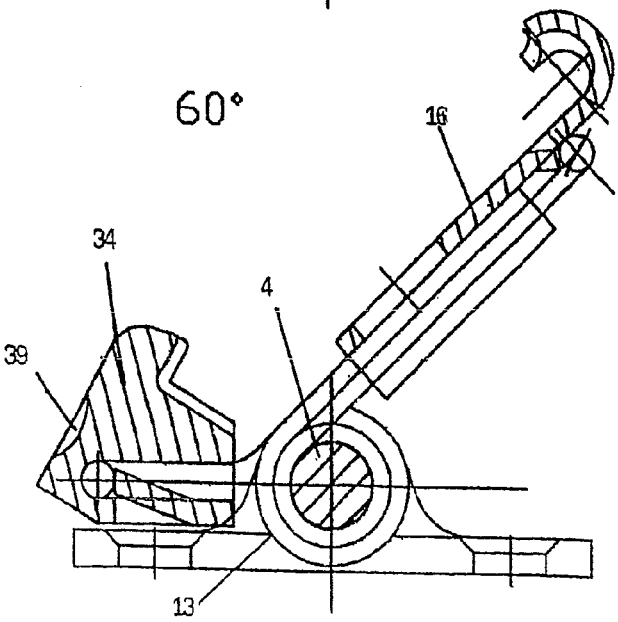

In the variant according to FIGS. 12 to 14, the same principle as in the embodiment according to FIGS. 6 to 8 is provided, wherein the axis 4, if necessary, may be a rivet or screw piece to hold the binding together. Contrary to the two last-described variants, the hook element 16 forming the retaining mechanism in this case is made of a spring steel and bent upwards on its end side, thus spirally enclosing the axis 4 while forming the spring element 13. This variant results in a stable construction, since a larger binding width is feasible. Moreover, its production is cost-saving, since the spring element 13 together with the hook element 16 will be supplied as a semi-finished product. The retention force is obtained by a material deformation of the hook element 16 when stepping into the binding, which is opened by inserting the ski pole into the depression 39 of the lever 34. In order to prevent the skier from tilting over, a spring may be incorporated in the axis 4, or a plastic part indicated in FIG. 12 in broken lines may provided below the tip of the boot, which plastic part is comprised of a two-component injection-molding part, namely a very soft damping component and a hard boot-retaining component.

Figure 15:
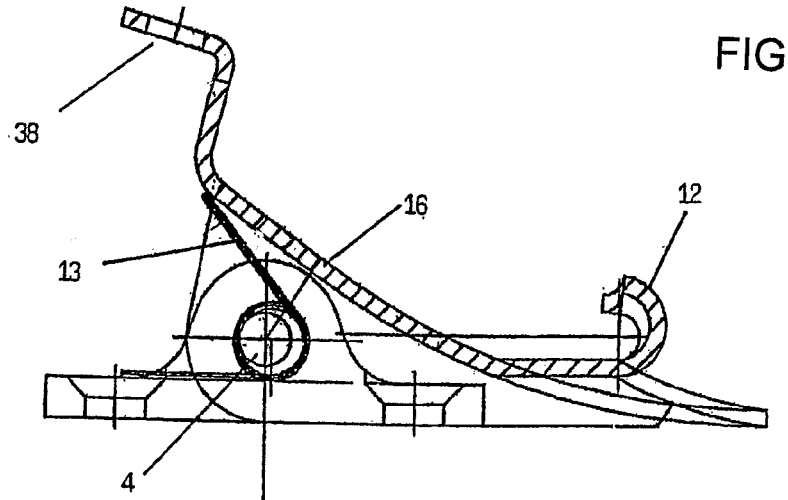
Figure 16:
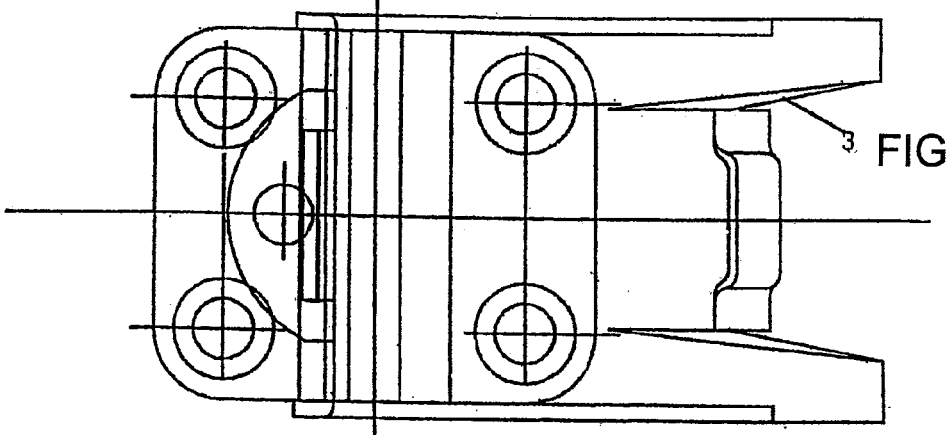
Figure 17:
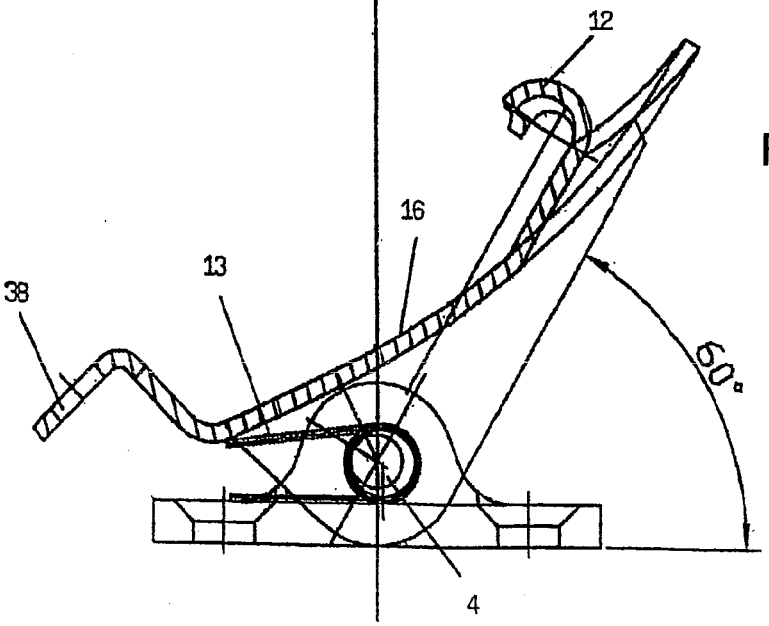

The variant according to FIGS. 15 to 17 is substantially based on the same principle as the variant according to FIGS. 9 to 11, with the difference that the construction is devised such that it is not to be embedded in the interior of the groove of the boot sole, since it is designed to be wider for stability reasons. In this variant, the hook element 16 made of chamfered spring steel sheet is supported on the spring 13 above the axis 4 in the region of its outward bend which is provided on the end of the hook element 16 facing away from the hook 12 for receiving the retaining pin in the tip region of the ski boot sole. The guidance of the hook element 16 above the axis 4 ensures a particularly stable construction, by which the retention of the ski boot is obtained by the deformation forces of the hook element 16 and the tilting over of a skier is prevented by the incorporated torsion spring 13.

Figure 18:
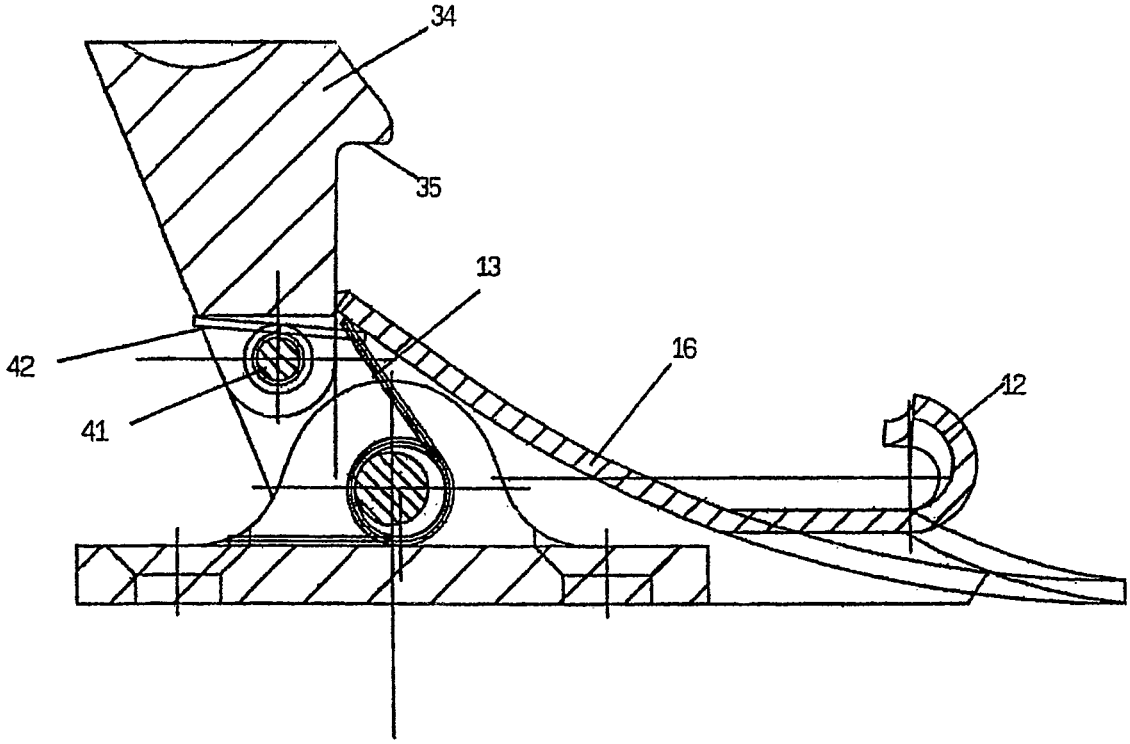
FIG. 18 depicts a longitudinal section through a further variant of the tip-side binding portion.

The variant according to FIG. 18 is based on the same principle as the variant according to FIGS. 6 to 8 and represents a construction to be produced with little expenditure, wherein the same reference numerals are used for identical components. The difference from the described variants consists in that the hook element 16 with its hook 12 for retaining the axis of the boot tip and the lever 34 are mounted separately from each other, with the lever 34 being mounted so as to be pivotable about a stationary axis 41 and biased by a spring 42, i.e. a torsion spring in the present case, in order to keep the boot in the closed position. The spring 13, again a torsion spring, acts on the end of the hook element 16 facing away from the hook 12 and running out substantially straightly.

Within the scope of the invention, various structural modifications are, of course, feasible. Thus, the torsion spring 13 may be replaced with a plastic part preferably configured as a two-component injection-molding part to obtain the effect of an elastomer damper.

The invention claimed is:

1. A configuration, comprising:

a ski boot having a boot sole with a tip and a heel;

a ski binding having a retaining element with at least three fixed points disposed in corners of an imaginary triangle for connecting said boot sole to said ski binding, said boot sole being pivotable, during a lifting of said heel, via a pivotable movement about an axis located on an upper side of a ski in a region of said tip of said ski boot functioning as a first fixed point, said retaining element having a rear retaining element disposed in a ball region of a foot functioning as a second fixed point, a front retaining element serving as a third fixed point to couple said ski binding with said boot, whereas a relative position of the three fixed points is fixed during the lifting of said heel;

said ski boot having a sole with a rounded outer sole surface, said rounded outer sole surface defining a toe spring measured from a ball contact point of said sole to a tip region of said sole; and said rear retaining element being pivotable about a stationary axis extending transversely to a longitudinal axis of the ski, said stationary axis being arranged in the toe spring below the rounded outer sole surface.

2. The configuration according to claim 1, wherein said first, second and third fixed points are disposed in the corners of the imaginary triangle being an imaginary right triangle, said front retaining element being said third fixed point provided for coupling said ski binding with said ski boot is a hook element overlapping said tip of said boot sole.

3. The configuration according to claim 2, wherein said first fixed point is a pivot point disposed in the corner having a largest interior angle.

4. The configuration according to claim 2, wherein said imaginary triangle has two legs oriented from said first fixed point being a pivot point in a direction towards a sole connection point, and a hypotenuse is generated by imaginary distance between two sole connection points.

5. The configuration according to claim 1, wherein said ski binding is formed of a three-part binding unit including said front retaining element and said rear retaining element each configured as a hook element as well as a hinge disposed therebetween and forming an axis of rotation.

6. The configuration according to claim 1, wherein said rear retaining element is made of spring steel, pivotable about a stationary axis extending transversely to a longitudinal axis of the ski, and loaded by said spring wound around said stationary axis.

7. The configuration according to claim 6, wherein said rear retaining element is an angle lever which is pivotable about said stationary axis and contains an undercut formed therein facing said hook element and serving to hold said tip of said ski boot.

8. The configuration according to claim 6, wherein said rear retaining element encloses said stationary axis as a biasing spring.

9. The configuration according to claim 6, wherein said front retaining element has a lever separated from said rear retaining element, said lever having an undercut formed therein for retaining said sole of said ski boot, said lever being mounted so as to be pivotable about a separate, stationary axis and being spring-loaded to keep said ski boot in a closed position.

10. A ski boot for a ski binding formed as a three-part binding unit including a front retaining element configured as a hook element, a rear retaining element configured as a hook element, and a hinge disposed therebetween and forming an axis of rotation, the ski boot comprising:

a sole including a tip and a heel, said sole having a rounded outer sole surface, said rounded outer sole surface defining a toe spring measured from a ball contact point of said sole to a tip region of said sole; and a stepped extension in a region of said sole tip, said stepped extension projecting in a running direction for receiving a hook surface of the front retaining element on an upper surface of the extension;

the stepped extension having a groove formed therein for receiving the front retaining element configured as a hook element, in order to take up transverse forces in engagement with the front retaining element; and a relative position of the front retaining element, the rear retaining element and the hinge being fixed during a lifting of said heel, said rear retaining element being pivotable about a stationary axis extending transversely to a longitudinal axis of the ski, said stationary axis being arranged in the toe spring below the rounded outer sole surface.

11. The ski boot according to claim 10, wherein said sole has a groove formed therein extending transversely to a running direction, in which an axle is embedded and serves as an anchorage point for the hook element of the rear retaining element.

12. The ski boot according to claim 11, wherein said axle is embedded by an injection-molding process.

13. A ski boot for a ski binding formed as a three-part binding unit including a front retaining element configured as a hook element, a rear retaining element configured as a hook element, and a hinge disposed therebetween and forming an axis of rotation, the ski boot comprising:

a sole including a tip and a heel, said sole having a rounded outer sole surface, said rounded outer sole surface being rounded starting from a ball contact point forwardly in a direction to said tip of said ski boot; and a stepped extension in a region of said sole tip, said stepped extension projecting in a running direction for receiving a hook surface of the front retaining element on an upper surface of the extension;

the stepped extension having a groove formed therein for receiving the front retaining element configured as a hook element, in order to take up transverse forces in engagement with the front retaining element; and a relative position of the front retaining element, the rear retaining element and the hinge being fixed during a lifting of said heel, wherein said sole has a longitudinally extending central groove formed therein for receiving the hook element of the rear retaining element and the rear retaining element of the ski binding in an opened state is pressed upwards from an upper surface of a ski by a measure x, and held in that position, by a spring element.

* * * * *